US005787663A

United States Patent [19]

Wehrmann

[11] Patent Number: 5,787,663

[45] Date of Patent: Aug. 4, 1998

[54] BEAM SUPPORT BRACKET FOR A RAISED ACCESS FLOOR

[75] Inventor: Gary Wehrmann, San Antonio, Tex.

[73] Assignees: Sony Corporation, Japan; Sony Electronics, Inc., Park Ridge, N.J.

[21] Appl. No.: 796,542

[22] Filed: Feb. 6, 1997

[51] Int. Cl.[6] ..... E04B 5/43

[52] U.S. Cl. ..... 52/263; 52/645; 52/650.3; 52/656.9; 52/745.13; 403/217; 403/305

[58] Field of Search ..... 52/263, 745.13, 52/645, 650.3, 656.9; 403/305, 300, 217, 218

[56] References Cited

U.S. PATENT DOCUMENTS 3,899,857 8/1975 Mochizuki ..... 52/263 X 5,371,985 12/1994 Suttles ..... 52/263 X 5,465,534 11/1995 Mittag ..... 52/263 X

*Primary Examiner*—Christopher Kent

*Attorney, Agent, or Firm*—Ronald P. Kananen

[57] ABSTRACT

A raised access floor and method for modifying a raised access floor understructure construction uses a beam support bracket which allows additional support beams to be installed at any desired location within the mid-span of the adjacent stringer support beams of the respective quadrant sections within the raised access floor understructure. The bracket is capable of being mounted at any position along the length of a stringer support beam of a raised access floor quadrant section. This allows for great flexibility in available understructure modification schemes to allow appropriate modification for a wide variety of different sized obstructions installed within the raised access floor understructure.

22 Claims, 8 Drawing Sheets

BEAM SUPPORT BRACKET FOR A RAISED ACCESS FLOOR

BACKGROUND OF THE INVENTION

1. Field of the Invention

The present invention relates generally to a raised access floor construction and raised access floor understructure modification method and, more specifically, to a beam support bracket which allows additional support beams to be installed in a raised access floor quadrant section.

2. Description of the Related Art

Raised access floor installations are commonly used in computer and telemarketing centers, electronics and biomedical manufacturing and research facilities, "clean" industrial rooms, or any other institution where specific climate control is required.

A raised access floor is typically constructed using rectangular or square panels extending horizontally and supported, at least at their corners, by pedestals arranged on an understructure 10 which is a grid of quadrant sections 20 as seen in FIG. 1.

As seen more clearly in FIG. 2, each quadrant section 20, nine of which are shown in FIG. 1, includes four horizontal stringer support beams 21 arranged in a frame shape. Each stringer support beam 21 has three evenly spaced adjacent pedestal assemblies 22 associated with the beam. Two of these pedestal assemblies 22 are positioned at the extreme ends of the stringer support beam 21 and have respective vertical columns 24 coupled to them and extending to the floor. The third pedestal assembly 23 is positioned midway between the other two pedestal assemblies 22 at a central position of the stringer support beam 21. A common configuration has the pedestals arranged on four foot centers.

Each quadrant section has a daisy wheel assembly 26 at each of the four corners of the frame, as seen in FIG. 2. The daisy wheel assembly 26 functions as a corner support for the stringer beams and is located between the corner pedestal assembly 22 and the vertical column 24 extending to the building floor.

Each quadrant section 20 also includes a diagonal support beam 25 connected diagonally between the lower left hand corner of the quadrant section and the upper right hand corner as shown in FIG. 1. Each diagonal support beam 25 has three evenly spaced pedestals associated with it as shown in FIG. 1 and FIG. 2.

The panels are arranged to form a work area floor and are spaced a predetermined distance above and parallel to the building floor by means of the support provided by this grid of pedestals and quadrant sections. Each 4' by 4' quadrant section supports four 2' by 2' panels. The panels which form the work area floor are each individually readily removable to allow easy access to the area between the building floor and the work area floor.

Often, it becomes necessary to modify part of the raised access floor. Modifications may include removing the diagonal beam support from a quadrant section or cutting off part of the raised access floor construction in order to install a piece of equipment or other obstruction. When such modifications are made, additional structural support for the remaining panels surrounding the obstruction often becomes necessary.

For example, if the diagonal support beam 25 and one or more of the stringer support beams 21 of a quadrant section need to be removed to make way for an obstruction being installed, additional support will need to be provided in order to support the remaining panels.

SUMMARY OF THE INVENTION

It is an object of the present invention to provide a beam support bracket and a method for modifying a raised access floor construction by installing an additional beam support anywhere in the adjacent beam support frame of a raised access floor quadrant section using one or more of the beam support brackets.

It is a further object of the present invention to provide a bracket assembly and modification method that results in flexibility to modify the raised access floor construction while still maintaining the loading that the floor was designed to withstand before modification.

Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects and in accordance with the purposes of the present invention, as embodied and broadly described herein, in a raised access floor quadrant section including four horizontal stringer support beams arranged in a frame for supporting at least one panel at a distance above and parallel to the building floor below, a first beam support bracket is provided that is capable of being mounted at any position along the length of a first stringer horizontal support beam of said raised access floor quadrant section. Also, a mid-span horizontal support beam, having first and second ends, is installed across a portion of the area within said frame and is attached to the first beam support bracket at its first end. A second beam support bracket is provided for being mounted at a corresponding position along the length of a second stringer horizontal support beam of said raised access floor quadrant section and is attached to said mid-span horizontal support beam at its second end.

The first and second beam support brackets are preferably constructed of rectangular tubing, and this tubing is preferably made of carbon steel.

The first and second beam support brackets are preferably painted with a two part conductive epoxy paint.

The quadrant section is preferably of a four foot on center construction.

The first and second beam support brackets preferably each comprise a cut-out section for interconnection with a pedestal assembly on a support beam of said raised access floor quadrant section. Also, the first and second beam support brackets may each comprise a saddle section for mounting the bracket over one of the stringer support beams.

According to a further aspect of the present invention, in a raised access floor quadrant section including four horizontal stringer support beams arranged in a frame for supporting at least one panel at a distance above and parallel to the building floor below, a first beam support bracket is provided that is capable of being mounted at any position along the length of a first stringer horizontal support beam of the raised access floor quadrant section.

A first mid-span horizontal support beam, having first and second ends, is installed across a portion of the area within the frame and attached to the first beam support bracket at its first end. A daisy wheel is provided that is mounted on a second stringer horizontal support beam of said raised access floor quadrant section and attached to the first mid-span horizontal support beam at its second end. A second beam support bracket, having first and second beam support extensions, is mounted on said first mid-span horizontal support beam between said first and second ends of said first mid-span horizontal support beam.

A second mid-span horizontal support beam, having first and second ends, is installed across a portion of the area within the frame and attached at its first end to said first beam support extension of the second beam support bracket. A third beam support bracket is mounted at a corresponding position along the length of a third stringer horizontal support beam of the raised access floor quadrant section and attached to the second mid-span horizontal support beam at its second end.

Finally, a third mid-span horizontal support beam, having first and second ends, is installed across a portion of the area within the frame and attached at its first end to the second beam support extension of the second beam support bracket. A second daisy wheel is mounted on a fourth stringer horizontal support beam of the raised access floor quadrant section and attached to the third mid-span horizontal support beam at its second end.

According to a further aspect of the present invention, the objects and purpose of the invention are achieved by a method of modifying a raised access floor quadrant section construction having adjacent stringer support beams forming a frame. The method comprises the steps of mounting a first beam support bracket on a first stringer support beam of said frame, mounting a second beam support bracket on a second stringer support beam of said frame, and installing a third support beam, having first and second ends, at any desired location in the mid-span of said adjacent stringer support beams by connecting said first and second ends to said first and second beam support brackets, respectively.

BRIEF DESCRIPTION OF THE DRAWINGS

The present invention will become more clearly appreciated as the disclosure of the present invention is made with reference to the accompanying drawings. In the drawings.

DETAILED DESCRIPTION OF THE INVENTION

Reference will now be made in detail to preferred embodiments of the invention, examples of which are illustrated in the accompanying drawings.

As described in the Background of the Invention, it often becomes necessary to modify part of the raised access floor construction. Modifications may include removing the diagonal beam support 25 or cutting off part of the raised access floor construction (i.e. part or all of a stringer support beam) in order to install a piece of equipment or other obstruction. Usually, a number of quadrant sections of the raised access floor understructure will have to be modified to make way for this obstruction. When such modifications are made, additional structural support for the panels often becomes necessary within the quadrant sections.

For example, if the diagonal support beam 25 and two of the stringer support beams 21 of a quadrant section need to be removed to make way for an obstruction being installed, at least one additional horizontal support beam will need to be provided at some position within the frame section of the adjacent stringer beams comprising the quadrant sections affected by the obstruction in order to continue to support their respective work access floor panels.

Figure 1:
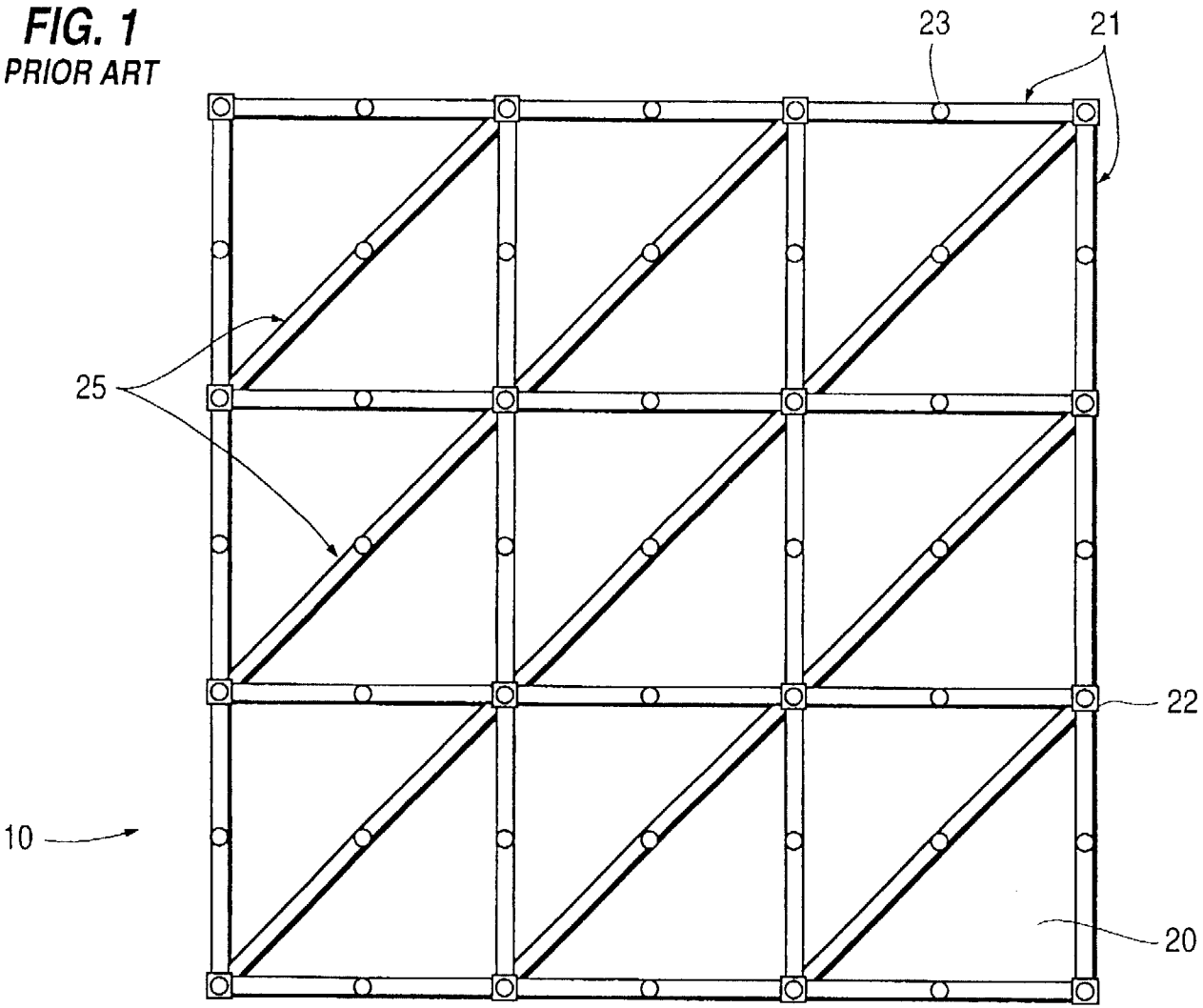
FIG. 1 PRIOR ART
FIG. 1 is a plan view of a conventional understructure for a raised access floor.
Figure 2:
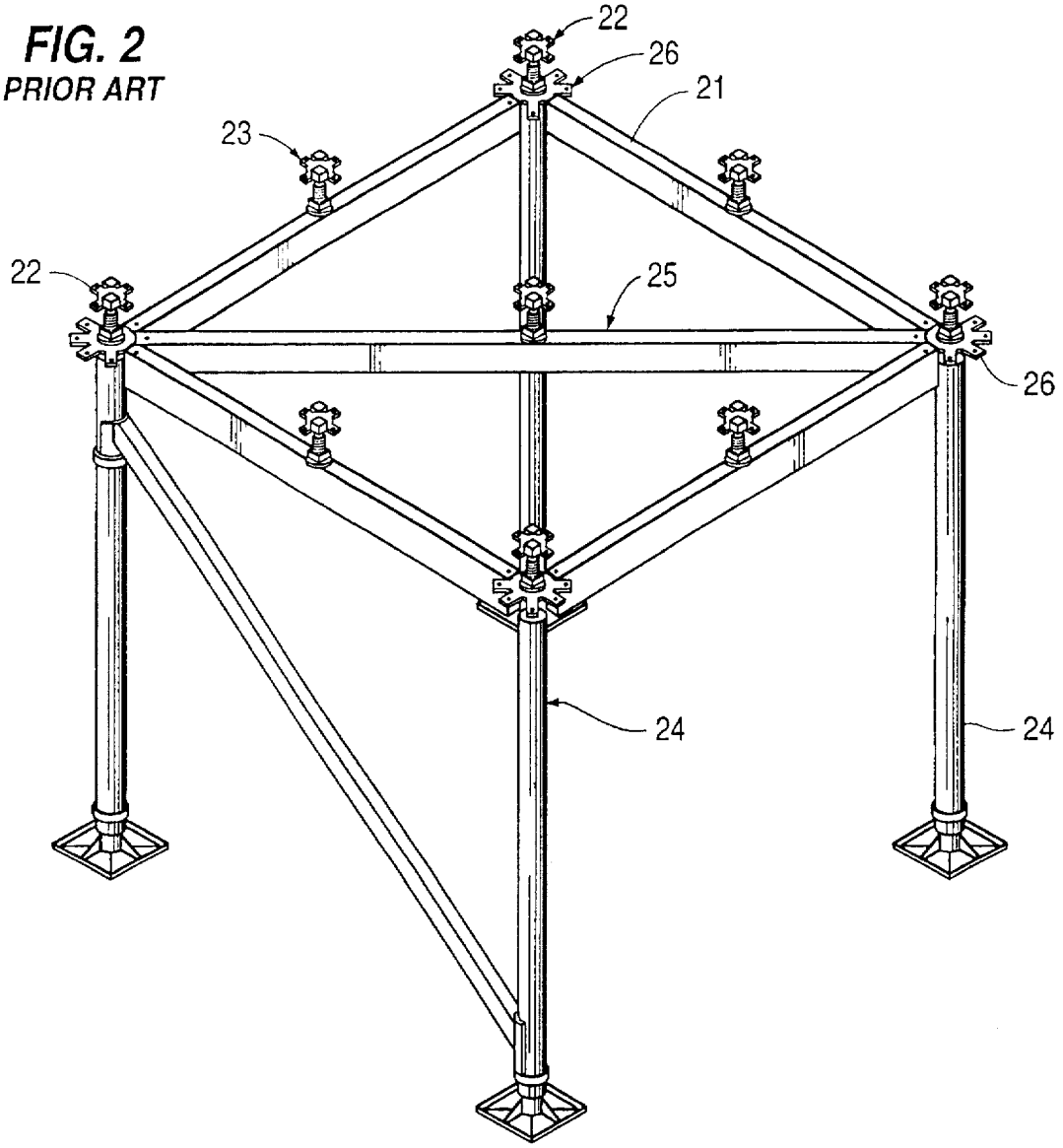
FIG. 2 PRIOR ART
FIG. 2 is a perspective view of a conventional raised access floor quadrant section.
Figure 3:
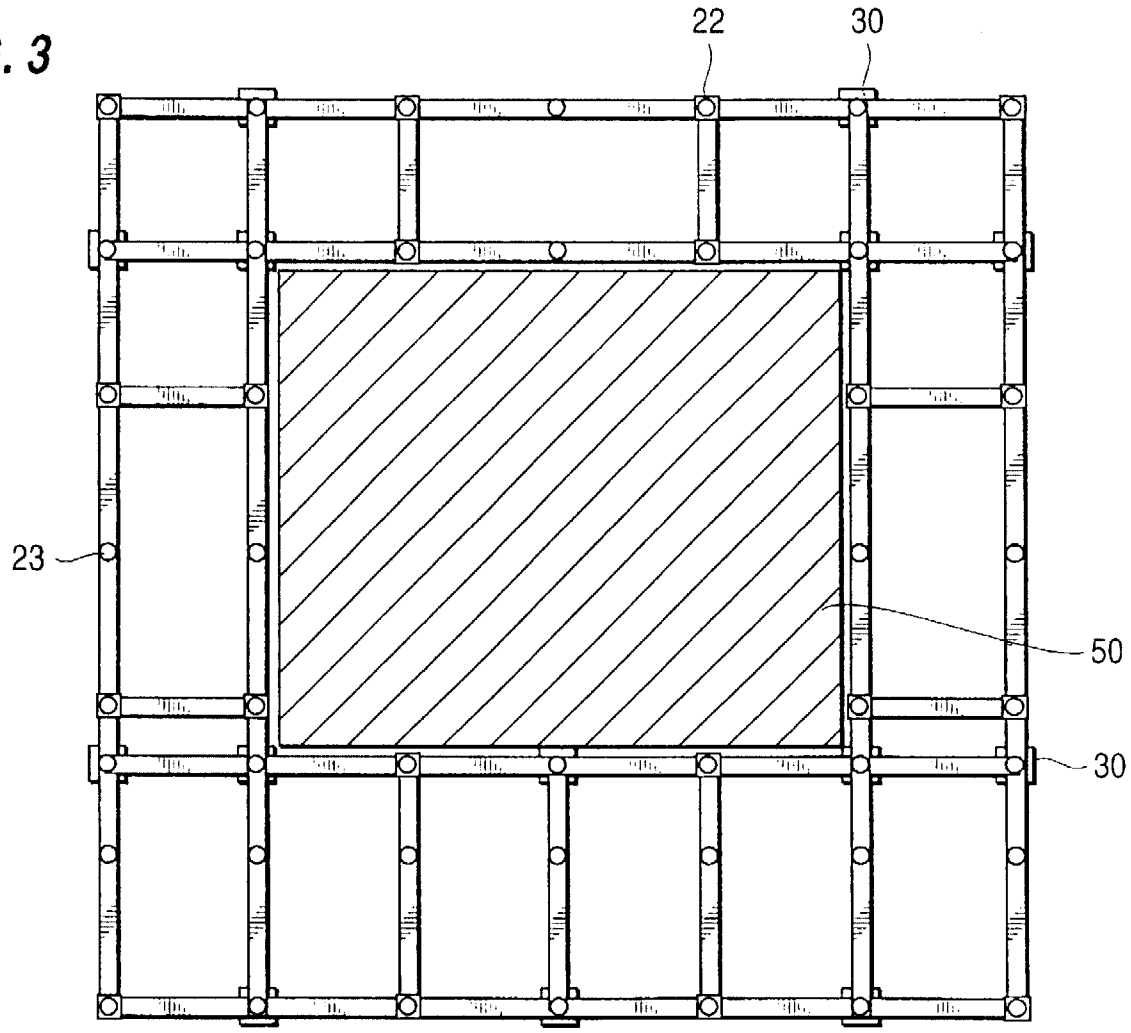
FIG. 3 is a plan view of a modified understructure for a raised access floor according to a preferred embodiment of the present invention showing adjustable pedestals and beam support brackets installed.

While FIG. 1 is a plan view of an understructure construction of a raised access floor without such an obstruction installed, FIG. 3 is a plan view of the same understructure for a raised access floor with modifications made to each of the quadrant sections, according to a preferred embodiment of the present invention, in order to accommodate for an obstruction 50 being installed within the construction of the raised access floor.

Figure 4:
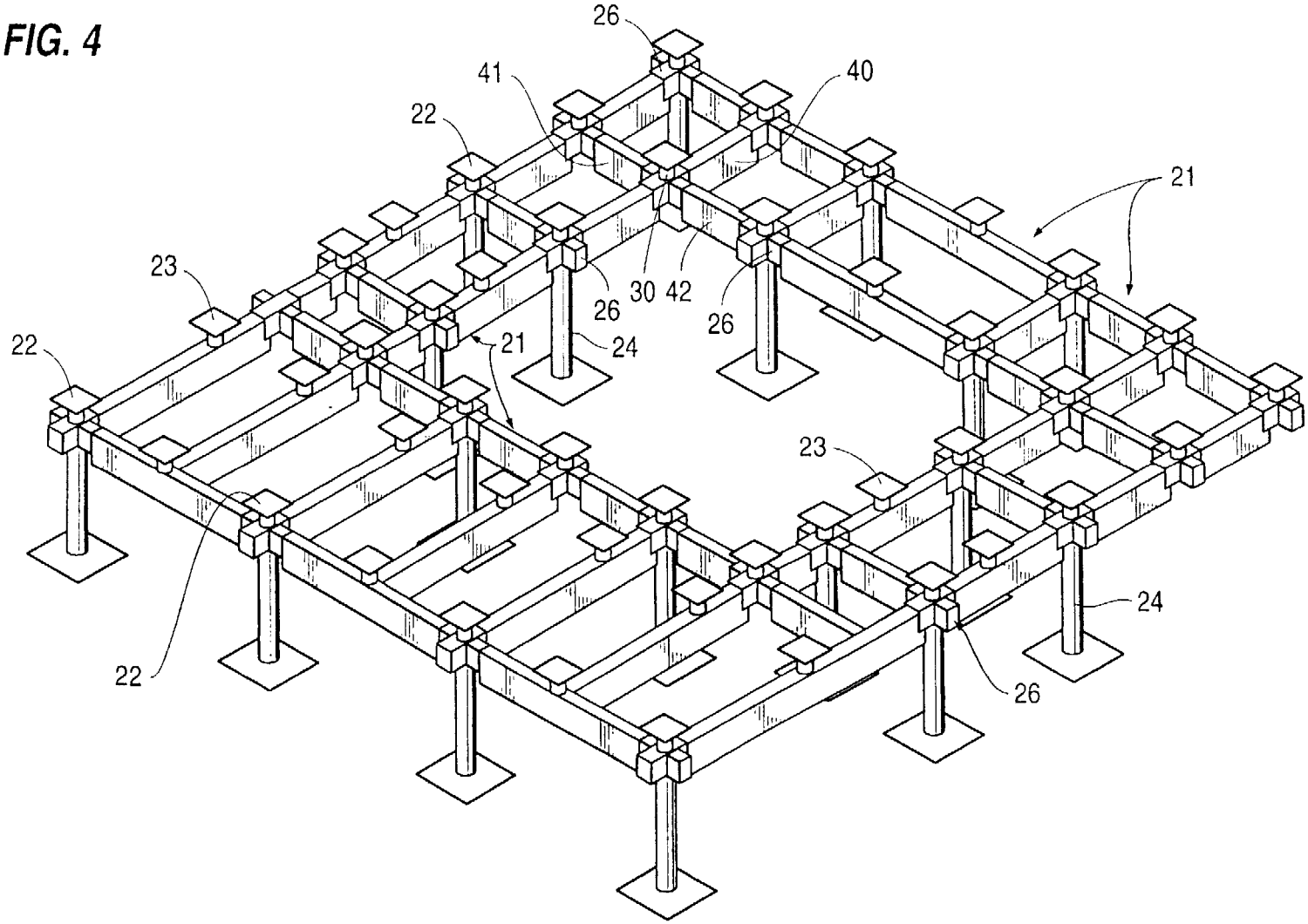
FIG. 4 is a perspective view of a modified understructure for a raised access floor according to a preferred embodiment of the present invention showing adjustable pedestals and beam support brackets installed.

FIG. 4 is a perspective view of the modified understructure as in FIG. 3.

As seen in FIGS. 3 and 4, each of the nine quadrant sections of original FIG. 1 had to be modified in order to accommodate for the obstruction being installed within the raised access floor construction. In order to make room for the obstruction, all of the diagonal support beams 25 shown in FIG. 1 had to be removed. Further, many portions of the stringer support beams 21 had to be removed. When these diagonal and stringer support beam sections are removed, there is no longer adequate support for holding up the work area panels that remain in the access floor construction after the installation of the obstruction. Thus, additional support is necessary in order to maintain the loading that the raised access floor construction was originally designed to withstand.

This additional support is accomplished through the use of beam support brackets 30 that allow additional support beams to be installed at any location within the frame area of each quadrant section.

Figure 5:
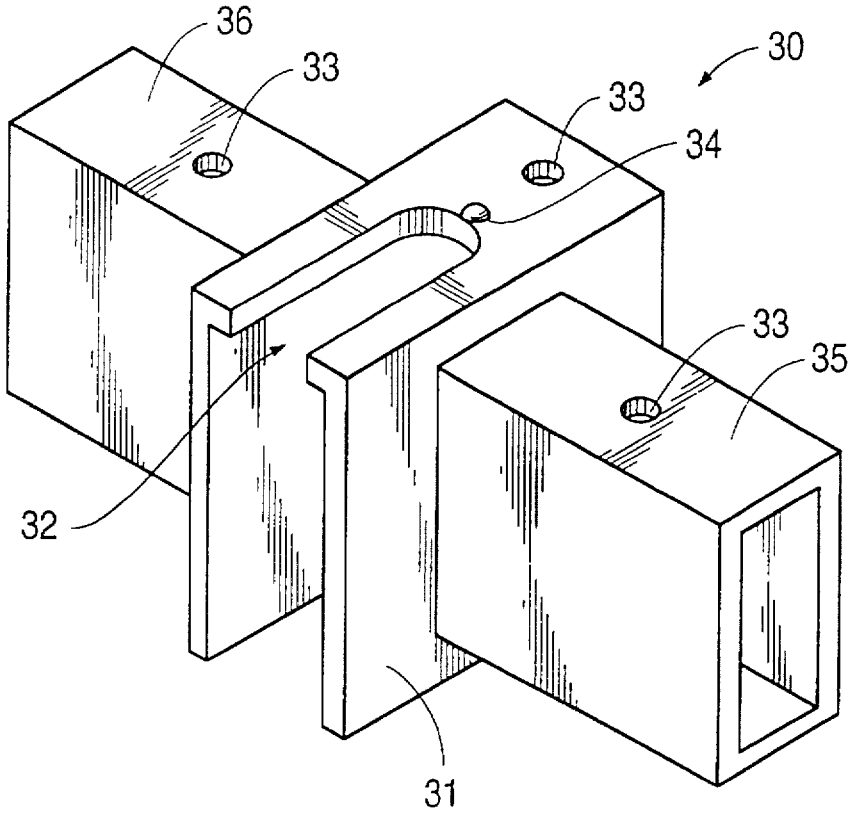
FIG. 5 is a perspective view of a beam support bracket according to a preferred embodiment of the present invention.

FIG. 5 is a perspective view of a beam support bracket 30 according to a preferred embodiment of the present invention. This bracket is designed to be mounted on a stringer support beam of a raised access floor quadrant section by way of its central saddle section 31.

This saddle section 31 includes a hole 33 on its top surface for receiving a bolt, screw, or the like to add stability to the connection of the bracket with, for example, a stringer support beam 21. Also, a cut-out section 32 is provided on the top surface of the saddle section 31 to allow interconnection of the mounted bracket with a pedestal assembly. While connection with a pedestal assembly is not required for proper functioning of the bracket, such connection is possible if necessary with respect to the desired placement of the bracket along the stringer support beam.

Saddle section 31 further includes a raised dimple 34 on its top surface between the cut-out section 32 and the hole 33. This dimple functions as a lock for the nut of a pedestal to allow a tight connection between the pedestal and the bracket.

The bracket also includes block-shaped beam support extensions 35 and 36 protruding from each side of the saddle section 31. These extensions are provided for interconnection with additional support beams that are added to the existing raised access floor during modification of the construction. Each extension is also provided with a hole 33 on their respective top surfaces for receiving a bolt, screw, or the like to add stability to the connection of the bracket with a support beam added to the construction during modification.

Figure 6A:
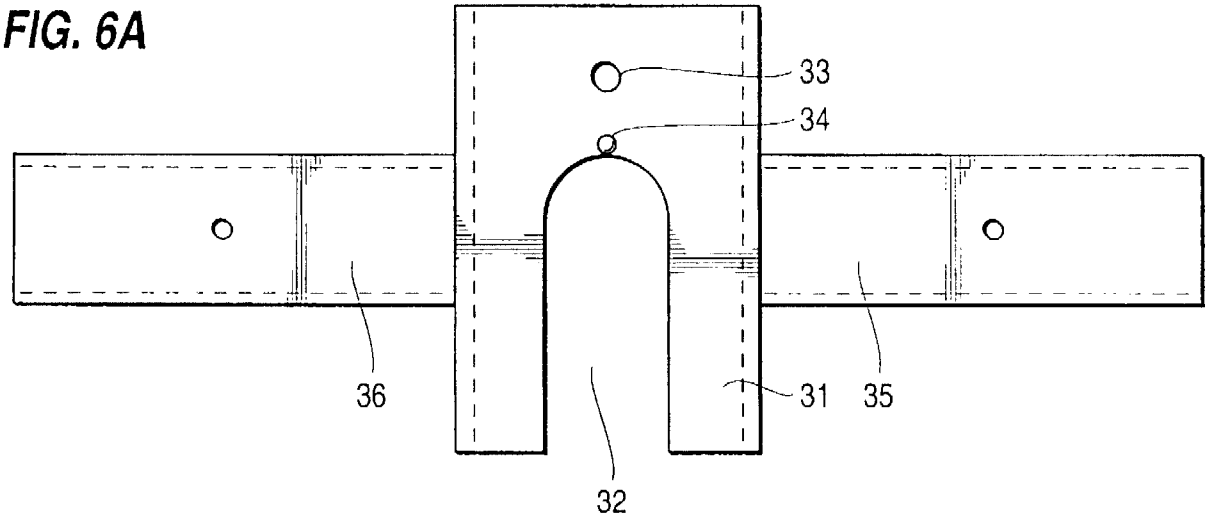
FIG. 6A is a side view of the beam support bracket of FIG. 5.
Figure 6B:
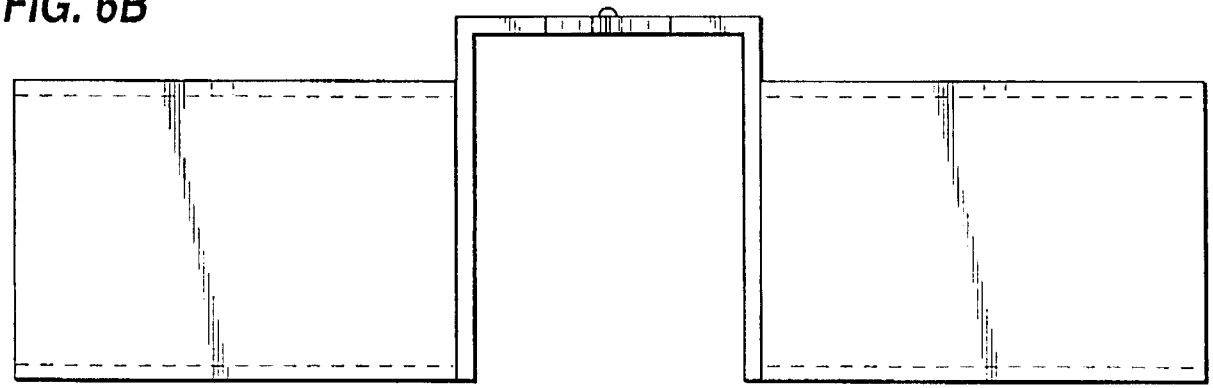
FIG. 6B is an end view of the beam support bracket of FIG. 5.

FIG. 6A is a side view of the beam support bracket of FIG. 5 and FIG. 6B is an end view of the beam support bracket of FIG. 5.

Figure 7:
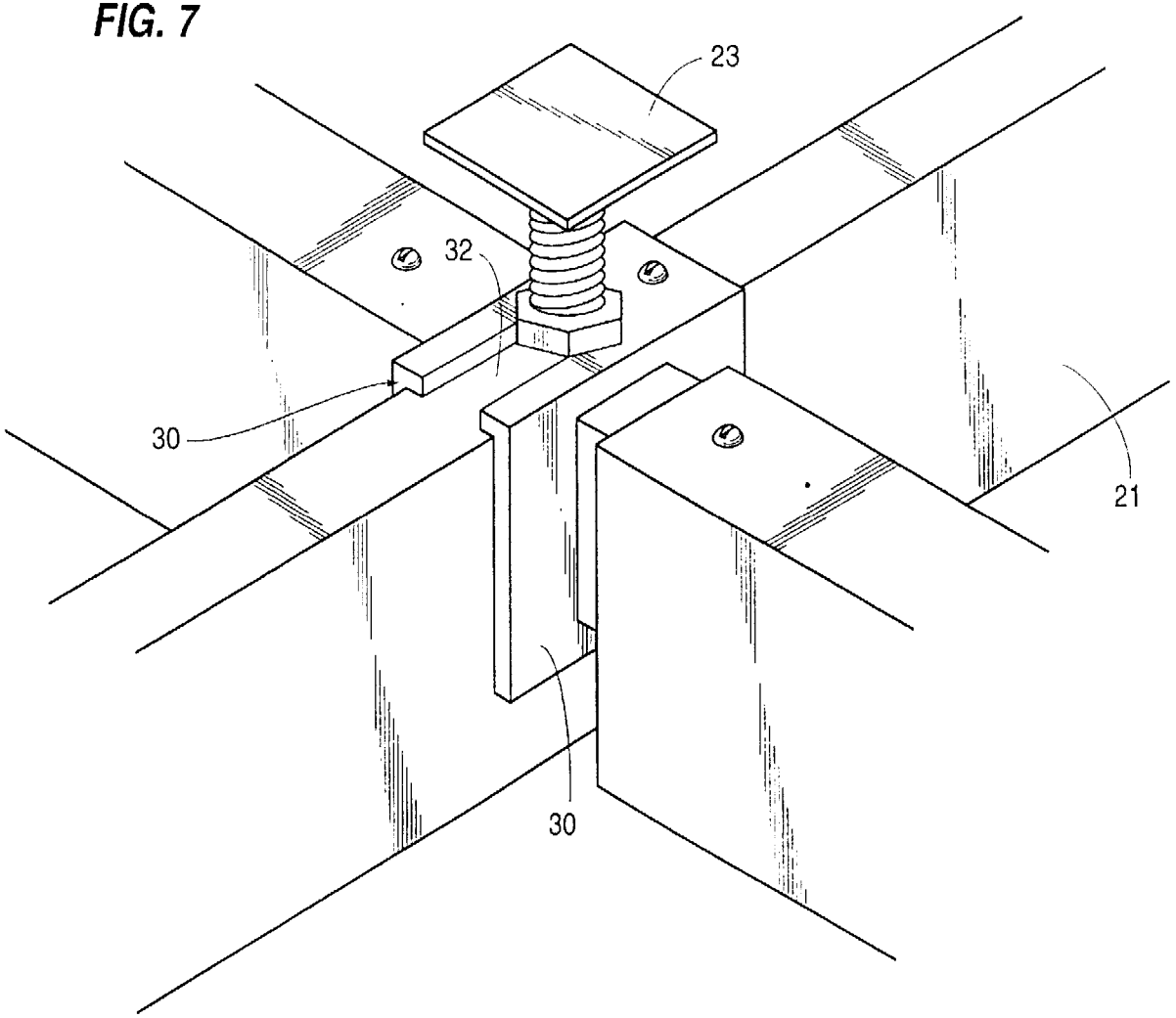
FIG. 7 is a perspective view of the beam support bracket of FIG. 5 installed on a stringer support beam of the raised access floor quadrant section with two additional support beams connected to the bracket.

FIG. 7 is a perspective view of the beam support bracket 30 installed on a stringer support beam 21 of the raised access floor quadrant section with two additional support beams connected to the bracket. It should be understood that the bracket may also be used to connect only one additional support beam in some applications. Alternatively, the bracket could be constructed with only one of the two beam support extensions.

The application shown in FIG. 7 also shows the cut-out section 32 of the bracket connected to a pedestal assembly by way of a nut. It should be understood that in other applications, the bracket may be attached to a location of the stringer support beam where no pedestal exists. The beam support bracket may be mounted and slid to any desired connection location along the length of the stringer support beam. Once the bracket is at the desired connection location for a particular application, it may be bolted or screwed in place.

Figure 8A:
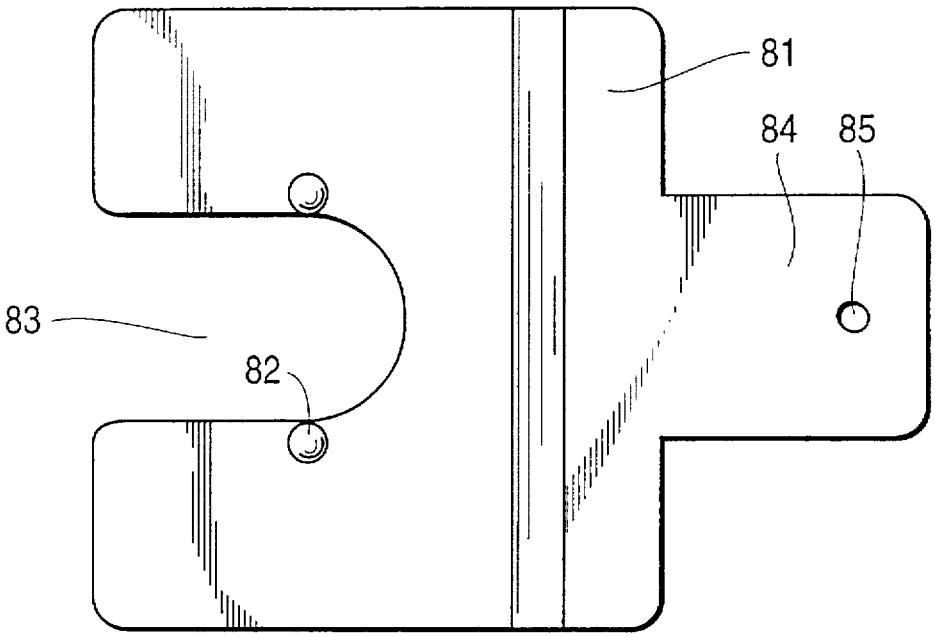
FIG. 8A is a plan view of another embodiment of the beam support bracket of the instant invention.
Figure 8B:
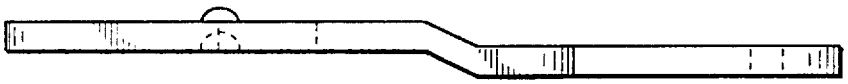
FIG. 8B is a side view of the beam support bracket embodiment of FIG. 8A.

FIG. 8A is a plan view of another embodiment of the beam support bracket of the instant invention. FIG. 8B is a side view of this embodiment. As seen in FIGS. 8A and 8B, this beam support bracket 81 comprises at least one hole 85 for fastening the bracket to an additional support beam to be added to a particular quadrant section. Also, there is a cut-out section 83 for allowing the bracket to be installed at a particular location along the length of a stringer support beam where a pedestal assembly may be installed. Dimples 82 are provided on the bracket to ensure a lock fit between the pedestal and the bracket. While this embodiment will not provide a support as strong as the bracket of FIG. 5 described above, it is of simpler construction and thus is cheaper to manufacture. Like the bracket of FIG. 5, this embodiment could be fastened, by bolts, screws, or the like, at any desired location along the length of a stringer support beam of the quadrant section.

Returning to FIGS. 3 and 4, the modified understructure of the raised access floor construction is shown utilizing the beam support bracket 30 of the instant invention. As indicated by the reference grid in FIG. 3, the modified understructure accommodates for the insertion of the obstruction 50 by using a combination of adjustable pedestals 23, adjustable pedestals 22 coupled to a vertical column 24 to the building floor, support beam brackets 30 and support beam brackets 30 attached to an adjustable pedestal 23.

For example, looking at the top right quadrant section of the modified understructure of FIG. 3, it can be seen that the inserted obstruction resulted in the diagonal support beam 25 having to be removed. Also, the bottom half of the left side stringer support beam of that frame as well as the left half of the bottom stringer support beam of that frame were removed. The vertical column originally at the lower left corner of that quadrant in FIG. 1 has been removed and relocated as shown in FIGS. 3 and 4. In order to adequately support the three panels above this quadrant section, additional support beams within the interior of the frame need to be added to the original structure of FIG. 1.

As best seen in FIG. 4, a first beam support bracket 30 is provided that is capable of being mounted at any position along the length of a first stringer 21 horizontal support beam of the raised access floor quadrant section.

A first mid-span horizontal support beam 40, having first and second ends, is installed across a portion of the area within the frame and attached to the first support beam bracket at its first end. A daisy wheel 26 is provided that is mounted on a second stringer horizontal support beam of said raised access floor quadrant section and attached to the first mid-span horizontal support beam at its second end.

A second beam support bracket 30, having first and second beam support extensions, is mounted on said first mid-span horizontal support beam 40 between said first and second ends of said first mid-span horizontal support beam 40.

A second mid-span horizontal support beam 41, having first and second ends, is installed across a portion of the area within the frame and attached at its first end to said first beam support extension of the second beam support bracket.

A third beam support bracket 30 is mounted at a corresponding position along the length of a third stringer horizontal support beam of the raised access floor quadrant section and attached to the second mid-span horizontal support beam 41 at its second end.

Finally, a third mid-span horizontal support beam 42, having first and second ends, is installed across a portion of the area within the frame and attached at its first end to the second beam support extension of the second beam support bracket. A second daisy wheel 26 is mounted on a fourth stringer horizontal support beam of the raised access floor quadrant section and attached to the third mid-span horizontal support beam 42 at its second end.

Thus, as indicated by these exemplary embodiments, the beam support bracket of the instant invention allows additional support beams to be installed at any desired location within the mid-span of the adjacent stringer support beams of the raised access floor quadrant sections. This results from the capacity of the bracket to be mounted at any position along the length of a stringer support beam of the understructure. A wide variety of modification schemes of the understructure are thus possible in order to make an appropriate change in response to a variety of obstructions sizes that may be installed within the raised access floor understructure.

These embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A raised access floor quadrant section including a plurality of horizontal stringer support beams arranged in a frame for supporting at least one panel at a distance above and parallel to a floor below, said quadrant section comprising:

a first beam support bracket adjustably mounted at any position along a first stringer horizontal support beam of said raised access floor quadrant section, said first beam support bracket having at least one beam support extension;

a second beam support bracket adjustably mounted along a second stringer horizontal support beam of said raised access floor quadrant section opposite said first beam support bracket, said second beam support bracket having at least one beam support extension;

a mid-span horizontal support beam, having first and second ends, said at least one beam support extension of said first beam support bracket being disposed in and supporting said first end of said mid-span horizontal support beam, and said at least one beam support extension of said second beam support bracket being disposed in and supporting said second end of said mid-span horizontal support beam.

2. In a raised access floor quadrant section as in claim 1, wherein said first and second beam support brackets are constructed of rectangular tubing.

3. In a raised access floor quadrant section as in claim 2, wherein said tubing is of carbon steel.

4. In a raised access floor quadrant section as in claim 1, wherein said first and second beam support brackets are painted with a two part conductive epoxy paint.

5. In a raised access floor quadrant section as in claim 1, wherein said quadrant section is of a four foot on center construction.

6. In a raised access floor quadrant section as in claim 1, wherein said first and second beam support brackets each comprise a cut-out section for receiving a pedestal assembly disposed on one of said stringer horizontal support beams.

7. In a raised access floor quadrant section as in claim 1, wherein said first and second beam support brackets each comprise a saddle section for mounting.

8. In a raised access floor quadrant section as in claim 7, wherein said saddle section comprises a cut-out section for receiving a pedestal assembly disposed on one of said stringer support beams.

9. A raised access floor quadrant section including plural horizontal stringer support beams arranged in a frame for supporting a panel at a distance above and parallel to a floor below, said quadrant section comprising:

a first beam support bracket adjustably mounted at any position along a first stringer horizontal support beam of said raised access floor quadrant section;

a first mid-span horizontal support beam, having first and second ends, said first end of said first mid-span horizontal support beam being attached to said first beam support bracket; and a daisy wheel mounted on a second stringer horizontal support beam and attached to said second end of said first mid-span horizontal support beam.

10. In a raised access floor quadrant section as in claim 9, further comprising:

a second beam support bracket, having first and second beam support extensions, mounted on said first mid-span horizontal support beam between said first and second ends of said first mid-span horizontal support beam;

a second mid-span horizontal support beam having first and second ends, said first end of said second mid-span horizontal support beam being attached to said first beam support extension of said second beam support bracket; and a third beam support bracket for adjustably mounted on a third stringer horizontal support beam, wherein said second end of said second mid-span horizontal support beam is attached to said third beam support bracket.

11. In a raised access floor quadrant section as in claim 10, further comprising:

a third mid-span horizontal support beam, having first and second ends, said first end of said third mid-span horizontal support beam being attached to said second beam support extension of said second beam support bracket; and a second daisy wheel mounted on a fourth stringer horizontal support beam and attached to said second end of said third mid-span horizontal support beam.

12. In a raised access floor quadrant section as in claim 9, wherein said beam support brackets are constructed of rectangular tubing.

13. In a raised access floor quadrant section as in claim 12, wherein said tubing is of carbon steel.

14. In a raised access floor quadrant section as in claim 9, wherein said beam support brackets are painted with a two part conductive epoxy paint.

15. In a raised access floor quadrant section as in claim 9, wherein said quadrant section is of a four foot on center construction.

16. In a raised access floor quadrant section as in claim 9, wherein said beam support brackets each comprise a cut-out section for interconnection with a pedestal assembly on a support beam of said raised access floor quadrant section.

17. In a raised access floor quadrant section as in claim 9, wherein said beam support brackets each comprise a saddle section for mounting over one of said stringer support beams.

18. In a raised access floor quadrant section as in claim 17, wherein said saddle section comprises a cut-out section for interconnection with a pedestal assembly on a support beam of said raised access floor quadrant section.

19. A method of modifying a raised access floor quadrant section having adjacent stringer support beams forming a frame comprising the steps of:

mounting a first beam support bracket on a first stringer support beam of said frame, and receiving in a cut-out section of said first beam support bracket a pedestal assembly disposed on said first stringer support beam;

mounting a second beam support bracket on a second stringer support beam of said frame, and receiving in a cut-out section of said second beam support bracket a pedestal assembly disposed on said second stringer support beam;

installing a third support beam, having first and second ends, at any desired location between said first and second stringer support beams by connecting said first and second ends to said first and second beam support brackets, respectively.

20. A method as in claim 19, further comprising constructing said first and second beam support brackets of rectangular tubing.

21. A method as in claim 20, further comprising constructing said first and second beam support brackets of rectangular tubing which is made of of carbon steel.

22. A method as in claim 19, further comprising painting said first and second beam support brackets with a two part conductive epoxy paint.

* * * * *